US005979552A

United States Patent [19]

Michael et al.

[11] Patent Number: 5,979,552

[45] Date of Patent: Nov. 9, 1999

[54] DUAL ANNULUS PRODUCTION TOOL

[75] Inventors: Clarence Michael, Pratt; Jeff Miller, Wichita, both of Kans.

[73] Assignee: Down Hole Injection, Inc., Wichita, Kans.

[21] Appl. No.: 08/901,945

[22] Filed: Jul. 29, 1997

Related U.S. Application Data

[60] Provisional application No. 60/023,866, Aug. 13, 1996.

[51] Int. Cl.[6] ..... E21B 43/00

[52] U.S. Cl. ..... 166/242.3; 166/369

[58] Field of Search ..... 166/106, 313, 166/242.3, 265, 369

[56] References Cited

U.S. PATENT DOCUMENTS

| | | | |
|---|---|---|---|
| 2,465,344 | 3/1949 | Bennett | 166/313 X |
| 5,425,416 | 6/1995 | Hammeke et al. | 166/105.5 |
| 5,579,838 | 12/1996 | Michael | 166/106 |

*Primary Examiner*—David Bagnell
*Assistant Examiner*—Sunil Singh
*Attorney, Agent, or Firm*—Flanagan & Flanagan; John R. Flanagan; John K. Flanagan

[57] ABSTRACT

A dual annulus production tool includes an upper annular seal provided in a sealing relationship with well casing bore below ground surface and above an opening in the casing, an elongated outer tubing in the casing bore extending from ground surface downward through and in a sealing relationship with the upper annular seal to an lower end of the outer tubing located below the upper annular seal, the outer tubing and casing defining an outer annulus therebetween extending from above the upper annular seal to the ground surface, an elongated inner tubing in the casing bore within the outer tubing extending from ground surface downward to a lower end of the inner tubing located below the upper annular seal, the outer and inner tubings defining an inner annulus therebetween for routing flow of fluid from below the upward annular seal upward through the inner annulus to ground surface without entering the outer annulus, and an annular housing in the casing bore below the upper annular seal and adjacent to a well production zone and being coupled to at least one of the respective lower ends of the outer and inner tubings and having fluid entry hole disposed above the opening in the casing for enabling flow of fluid from the casing bore into and upward through the inner annulus to the ground surface.

22 Claims, 2 Drawing Sheets

DUAL ANNULUS PRODUCTION TOOL

This application claims the benefit of U.S. provisional application No. 60/023,866, filed Aug. 13, 1996.

BACKGROUND OF THE INVENTION

1. Field of the Invention

The present invention generally relates to the separation and disposal of an undesired heavier fluid, such as water, from a desired lighter fluid, such as oil and gas, below ground surface in a production well and, more particularly, is concerned with a dual annulus production tool which facilitates the employment of a patented below production disposal (BPD) tool in wells where there is a risk of well casing corrosion from "sour" gas flowing therein above the production zone.

2. Description of the Prior Art

Oil and/or gas production wells generally produce two types of fluids, one being a desired lighter fluid, such as oil and/or gas, and another being an undesired heavier fluid, such as water or the like. Co-produced undesired fluids must be separated and properly disposed of. Traditionally, undesired fluids have been pumped to the surface along with desired fluids and then separated from the desired fluids and transported to another location where they are pumped down a separate well into a subterranean disposal formation. This "surface" approach is inappropriate for many production wells not only because it is very costly, but also because it raises the potential for adverse environmental impacts due to the possibility of an inadvertent escape of undesired fluids during transport and disposal.

Alternatively, undesired fluids can be separated from desired fluids in the production well below ground and then pumped into a disposal formation without ever being brought to the surface. This "in-situ" approach eliminates the need to transport the undesired fluids to a separate disposal well, thereby reducing the disposal costs and environmental risks associated with disposal of undesired fluids. The in-situ approach, however, requires the availability of an appropriate disposal formation. A below production disposal (BPD) tool, disclosed in U.S. Pat. No. 5,425,416 to Hammeke et al. and assigned to the assignee of the present invention, was developed to provide injection of undesired fluids into a disposal formation located below the production zone. An above production disposal (APB) tool assembly, disclosed in U.S. Pat. No. 5,579,838 to Michael and assigned to the assignee of the present invention, was developed to provide injection of undesired fluids into a disposal formation located above the production zone.

There are some wells that have candidate disposal formation zones located below the production formation zone where the patented BPD tool could be used but for the risk that "sour" gas found in these wells may corrode the casing of the well at points above the production zone, resulting in leakage that may adversely affect ground water. Environmental regulations now require that the casings of these wells be protected on the inside by loading the casing annulus with a head of non-corrosive fluid. Such regulation, while protecting the well casing, effectively prevents oil and/or gas from being removed from the well through the same casing annulus as has occurred heretofore when the patented BPD tool is utilized. Thus, a need remains for a solution to this problem in order to facilitate the use of the BPD tool in these wells for disposing undesired fluids in a lower disposal zone.

SUMMARY OF THE INVENTION

The present invention provides a dual annulus production (DAP) tool designed to satisfy the aforementioned need. The DAP tool of the present invention provides a solution to the aforementioned problem which allows removal of oil and/or gas from a production well and reduces the risk of corrosion of the casing of the well in the process by providing a pair of outer and inner tubings defining a passageway therebetween for the oil and/or gas to follow up out of the well without entering the well casing annulus and contacting the inside of the well casing.

Accordingly, the present invention is directed to a dual annulus production tool for use in a casing of a well extending downward from ground surface through an underground fluid production zone and having an interior bore extending downward from the ground surface to the production zone and an opening in the casing adjacent to the production zone allowing flow of fluid from the production zone into the bore of the casing. The dual annulus production tool comprises: (a) an upper annular seal for placing in the bore of the casing of the well spaced below ground surface and above the opening in the casing of the well and in a sealing relationship with the casing; (b) an elongated outer tubing for placing in the bore of the casing of the well extending from the ground surface downward through and in a sealing relationship with the upper annular seal to an lower end of the outer tubing located below the upper annular seal, the outer tubing having an imperforate tubular sidewall and a diameter sufficiently smaller than a diameter of the casing of the well to define an outer annulus therebetween for holding an annular volume of a static fluid therein extending from above the upper annular seal to the ground surface to impede corrosion of the casing of the well; (c) an elongated inner tubing for placing in the bore of the casing of the well within the outer tubing extending from the ground surface downward to a lower end of the inner tubing located below the upper annular seal, the inner tubing having an imperforate tubular sidewall and a diameter sufficiently smaller than the diameter of the outer tube to define an inner annulus therebetween being non-communicative with the outer annulus for routing flow of fluid from below the upward annular seal upward through the inner annulus to the ground surface without and being prevented from entering the outer annulus; and (d) an annular housing for placing in the bore of the casing of the well below the upper annular seal and adjacent to the production zone, the annular housing being couplable to at least one of the lower ends of the outer and inner tubings, the annular housing having at least one fluid entry hole disposed above the opening in the casing for enabling flow of fluid from the casing into and upward through the inner annulus to the ground surface and thereby avoiding the flow of fluid entering the outer annulus and contacting the casing.

More particularly, the annular housing has a plurality of the entry holes formed therein. The entry holes are spaced from one another circumferentially about the annular housing. The lower end of the outer tubing is externally threaded and spaced above the lower end of the inner tubing. The annular housing has an internally threaded open top end and is coupled to the outer tubing by being threadably secured at the open top end about the lower end of the outer tubing. Further, the tool comprises a lower annular seal provided between the inner tubing and annular housing below the entry hole in the annular housing so as to block flow of fluid from the inner annulus downward below the lower end of the inner tubing.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2:
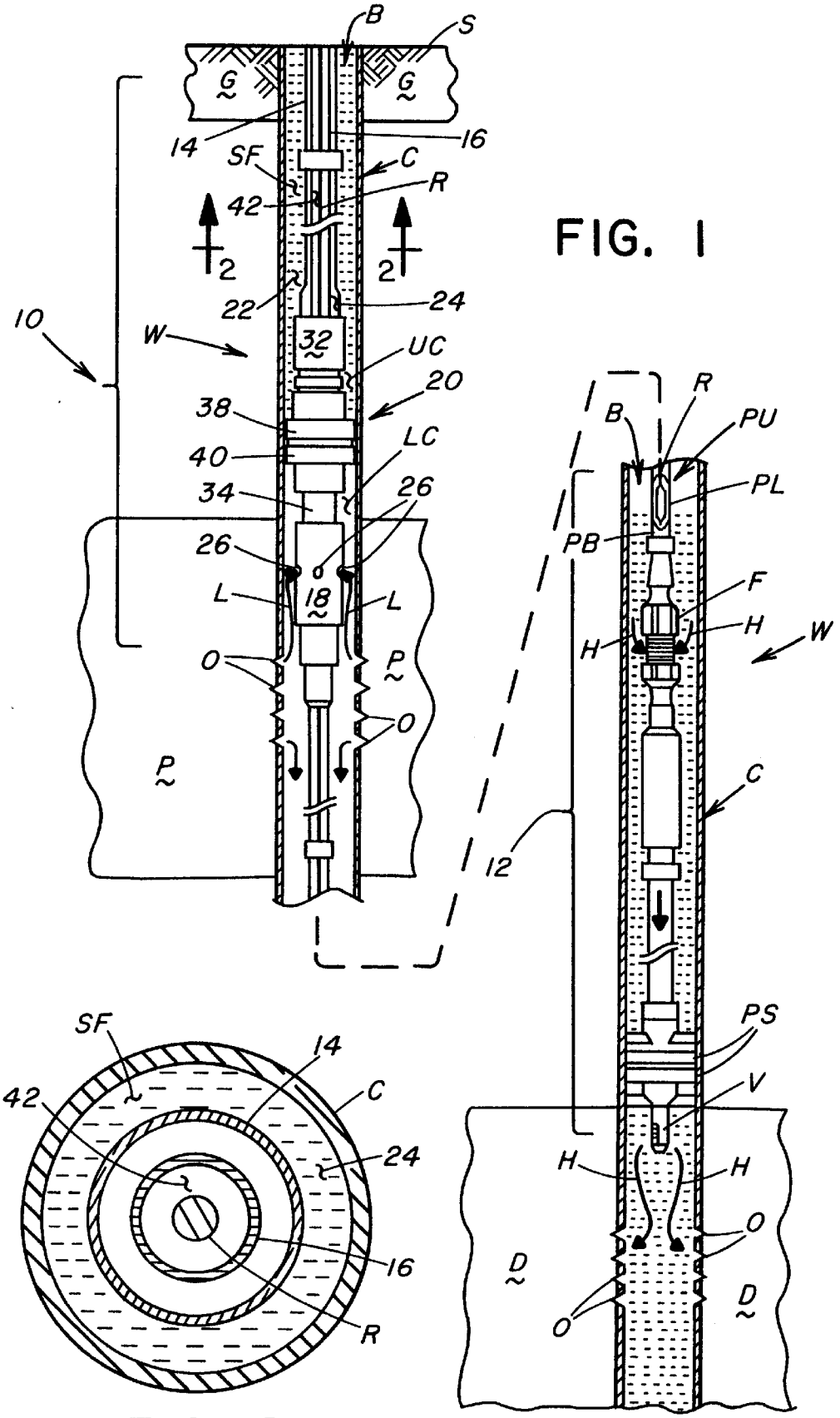
FIG. 1 is a vertical sectional view of a well bore of a production well in which a dual annulus production (DAP) tool of the present invention is employed with the below production disposal (BPD) tool of aforesaid U.S. Pat. No. 5,425,416.
FIG. 2 is an enlarged cross-sectional view of the well taken along line 2—2 of FIG. 1.
Figure 4:
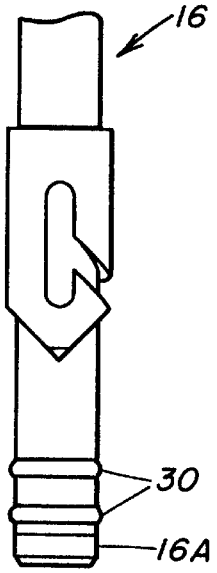
FIG. 4 is an elevational view of a fragmentary lower end portion of an inner tubing of the DAP tool of FIG. 3.

Referring to FIG. 1 of the drawings, there is illustrated the DAP tool, generally designated 10, of the present invention. The DAP tool 10 is inserted into a bore B of an elongated tubular well casing C of an oil and/or gas production well W. The well casing C extends from a ground surface S downwardly through a ground water zone G, through an oil and/or gas production formation zone P and into a disposal formation zone D. The well casing C is provided with a plurality of upper openings O at the respective elevation of the production zone P and the disposal zone D so as to facilitate flow communication of fluids through the well casing C at such elevations. The production zone P yields a desired lighter fluid, such as oil and/or gas, as represented by arrows L, and an undesired heavier fluid, such as water or the like, as represented by arrows H, which pass into the well casing C through the openings O thereof. The fluids separate due to the effect of gravity, with the desired lighter fluid L rising upward through the casing C while the undesired heavier fluid H flows downward through the casing C.

The DAP tool 10 of the present invention functions in conjunction with the prior art BPD tool, generally designated 12, disclosed in the above-cited U.S. Pat. No. 5,425,416, to permit use of the in-situ approach to disposal of the undesired heavier fluid H in the lower disposal zone D below the production zone P while protecting the well casing C above the production zone P in accordance with environmental regulations. The BPD tool 12 is located in the casing C below the elevation of the production zone P and the DAP tool 10 and above the elevation of the disposal zone D. The BPD tool 12 functions to receive the downward flow of the undesired heavier fluid H via an intake flow control mechanism F of the BPD tool 12 in response to an upstroke of a plunger PL of a conventional pump PU located within a pump barrel PB extending and connected between the DAP tool 10 and the BPD tool 12 above the intake flow control mechanism F thereof. The BPD tool 12 also functions in response to a downstroke of the plunger PL of the pump PU to force the undesired heavier fluid H down through a lower packer seal PS of the BPD tool 12 and past an one-way valve V of the BPD tool 12 and out through the lower openings O of the well casing C into the disposal zone D.

A detailed understanding of the construction and operation of the prior art BPD tool 12 is not necessary for one of ordinary skill in the art to fully and completely understand the construction and operation of the DAP tool 10 of the present invention which follows below, in view that the DAP tool 10 is also useful in applications where the BPD tool 12 is not to be used. However, for purposes of compliance with any applicable requirements of the U.S. patent laws, the disclosure of U.S. Pat. No. 5,425,416 is hereby incorporated herein by reference thereto.

In accordance with the present invention, the DAP tool 10 is disposed in the bore B of the well casing C below the ground surface S so as to assume a position extending downward from the ground surface S to substantially adjacent to production zone P and above the prior art BPD tool 12. Referring now to FIGS. 1 to 4, the DAP tool 10 basically includes an elongated outer tubing 14, an elongated inner tubing 16, an annular housing 18, and an upper annular seal 20. The outer tubing 14 of the DAP tool 10 has an imperforate sidewall and is of a diameter size small enough relative to the diameter of the casing C to define an outer annulus 22 therebetween and above the upper annular seal 20 for holding an annular volume or head of a static fluid SF therein which will not cause corrosion of the casing C. The diameter of the outer tubing 14 is also large enough to place the inner tubing 16 of the DAP tool 10 therethrough with sufficient spacing provided between them to define a longitudinal inner annulus 24 therebetween extending from below the upper annular seal 20 to the ground surface S. The inner tubing 16 has an imperforate sidewall and is of a diameter size small enough to define the desired inner annulus 24 with the outer tubing 14 being non-communicative with the outer annulus 22. The diameter of the inner tubing 16 is large enough to run a suitable elongated member R, such as sucker or drive rod, therethrough which is attached to an upper end of the plunger PL of the prior art pump PU employed with the prior art BPD tool 12 for driving the pump plunger PL through the respective upstrokes and downstrokes for operation of the BPD tool 12. By way of example only, the outer tubing 14 of the DAP tool 10 can optimally have a diameter of about 3½ inches while the inner tubing 16 can have a diameter of about 2¹⁄₁₆ inches.

The outer and inner tubings 14, 16 of the DAP tool 10 extend from the ground surface S downwardly to locations where at least one of them couples with the annular housing 18 of the DAP tool 10 which is disposed proximally adjacent to the production zone P and above the upper openings 0 of the casing C. As mentioned above, the outer and inner tubings 14, 16 together define the desired longitudinal inner annulus 24 therebetween through which the desired lighter fluid L, after passing into the interior bore B of the well casing C from the production zone P, can flow upwardly and out of the production well W without and, due to the respective imperforate sidewalls of the outer and inner tubings 14, 16, being prevented from entering the outer annulus 22 of the well casing C and contacting the casing C. The annular housing 18 has one or more entry holes 26 formed in its cylindrical sidewall 18A which can receive the desired lighter fluid L therethrough after the desired lighter fluid L enters the interior bore B of the well casing C from the production zone P and rises due to the pressure imposed upon the lighter fluid L by the surrounding strata of the earth. The lighter fluid L passes into the inner annulus 24 and rises upwardly therethrough to the ground surface S. The bottom 28 of the inner annulus 24 is closed or blocked by a lower annular seal 30 of the DAP tool 10 disposed between the outer and inner tubings 14, 16 below the entry holes 26 in the annular housing 18 so as to prevent the desired lighter fluid L from passing downward rather than upward toward the ground surface S.

The upper annular seal 20 of the DAP tool 10 is provided in the well casing C in a sealing relationship therewith and also is disposed in a sealing relationship with and around the outer tubing 14 at a location above the entry holes 24 in the annular housing 18 so as to provide for separation of the interior bore B of the well casing C into an upper chamber UC for holding the head of static fluid SF in the outer annulus 22 in the upper chamber UC and a lower chamber LC for containing the desired lighter and undesired heavier fluids L, H separated from the outer annulus 22 of the upper chamber UC. The static fluid SF in the outer annulus 22 is a suitable liquid, such as water, that will not cause, or will impede, deterioration of the well casing C and thereby enables the production well W to meet the above-mentioned environmental requirements for use of the "in-situ" approach to fluid disposal.

Figure 3:
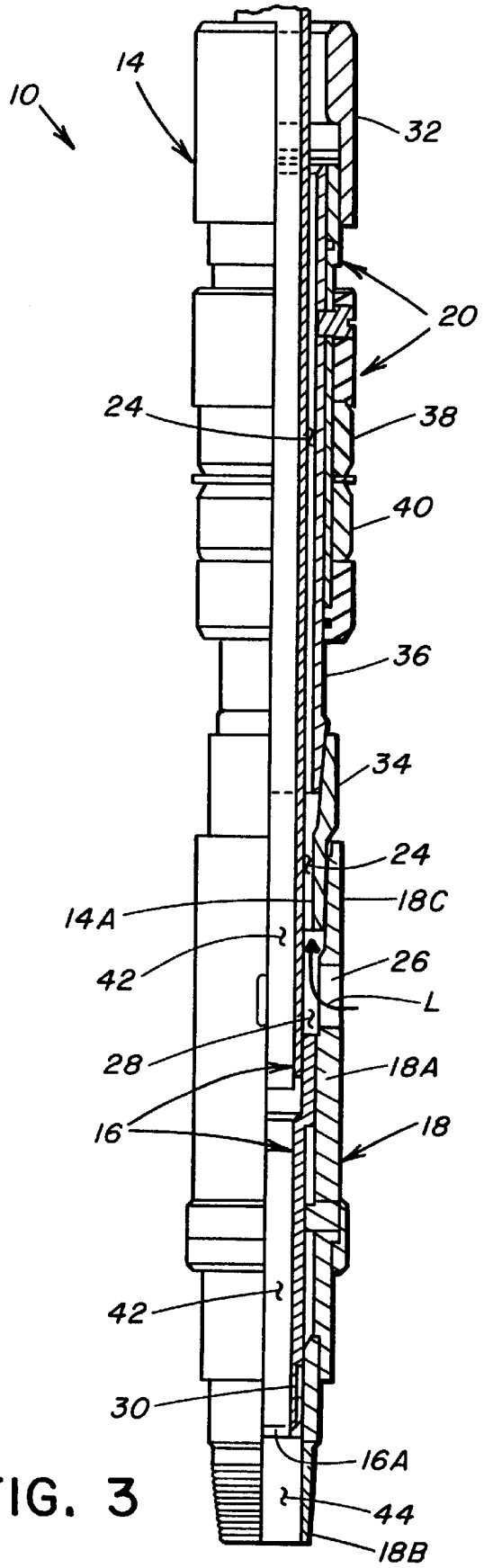
FIG. 3 is an enlarged elevational view of the DAP tool with a portion longitudinally sectioned to show the components of the tool.

More particularly, the lower end portion 14A of the outer tubing 14, as seen in FIG. 3, includes a plurality of annular fittings 32, 34 and a sleeve 36 threadably connected together and supporting annular packer seals 38, 40 secured thereabout which form the annular upper seal 20. The inner tubing 16 has an interior passageway 42 and its lower end 16A is open for allowing passage of the pump plunger drive rod R downward through the inner tubing 16 and the upper annular seal 20 from the ground surface to below the lower end 16A of the inner tubing 16. Also, the annular housing 18 has an interior chamber 44 and an open bottom end 18B for allowing passage of the drive rod R downward through and to plunger PL located within the pump barrel PB attached to bottom end 18B of the annular housing 18. The one fitting 34 at the lower end 14A of the outer tubing 14 is externally threaded and spaced above the lower end 16A of the inner tubing 16. The annular housing 18 has an internally threaded open top end 18C being coupled to the outer tubing 14 by being threadably secured about the one fitting 34 at the lower end 14A of the outer tubing 14. The entry holes 26 in the annular housing 18 are spaced from one another circumferentially about the annular housing 18. The lower annular seal 30 is provided about the lower end 16A of the inner tubing 16 between the inner tubing 16 and the annular housing 18 below the entry holes 26 in the annular housing 18 so as to block flow of fluid from the inner annulus 24 downward below the lower end 16A of the inner tubing 16.

In summary, the advantages and benefits derived from the above-described DAP tool 10 are that it: (1) provides a means to flow gas to the surface while protecting the integrity of the well casing; (2) can be used in the simultaneous gas/production and water disposal process; (3) can be used with conventional insert or tubing pumps and pump the produced fluid to surface and flow gas to surface; (4) can be used to flow water-free gas to surface and protect the production casing life; (5) can be used in wells where the producing zone is gravel packed; (6) can be used when the casing has deteriorated and expense of repairing the casing is cost prohibitive; and (7) can extend the profitable life of both older and newly drilled wells.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A dual annulus production tool for use in a casing of a well extending downward from ground surface through an underground fluid production zone and having an interior bore extending downward from the ground surface to the production zone and an opening in said casing adjacent to the production zone allowing flow of fluid from the production zone into the bore of the casing, said tool comprising:

(a) an upper annular seal for placing in the bore of the casing of the well spaced below ground surface and above the opening in the casing of the well and in a sealing relationship with the casing;

(b) an elongated outer tubing for placing in the bore of the casing of the well extending from the ground surface downward through and in a sealing relationship with said upper annular seal to an lower end of said outer tubing located below said upper annular seal, said outer tubing having an imperforate tubular sidewall and a diameter sufficiently smaller than a diameter of the casing of the well to define an outer annulus therebetween for holding an annular volume of a static fluid therein extending from above said upper annular seal to the ground surface to impede corrosion of the casing of the well;

(c) an elongated inner tubing for placing in the bore of the casing of the well within said outer tubing extending from the ground surface downward to a lower end of said inner tubing located below said upper annular seal, said inner tubing having an imperforate tubular sidewall and a diameter sufficiently smaller than said diameter of said outer tube to define an inner annulus therebetween being non-communicative with said outer annulus for routing flow of fluid from below said upward annular seal upward through said inner annulus to ground surface without and due to said imperforate sidewalls of said outer and inner tubings being prevented from entering said outer annulus; and (d) an annular housing for placing in the bore of the casing of the well below said upper annular seal and adjacent to the production zone, said annular housing being couplable to at least one of said respective lower ends of said outer and inner tubings, said annular housing having at least one fluid entry hole disposed above the opening in the casing for enabling flow of fluid from the casing into and upward through said inner annulus to the ground surface and thereby avoiding the flow of fluid entering said outer annulus and contacting the casing.

2. The tool of claim 1 further comprising:

a lower annular seal provided in said annular housing below said entry hole in said annular housing so as to block flow of fluid from said inner annulus downward below said annular housing.

3. The tool of claim 1 wherein said annular housing has a plurality of said entry holes formed therein.

4. The tool of claim 3 wherein said entry holes are spaced from one another circumferentially about said annular housing.

5. The tool of claim 1 wherein said inner tubing has an interior passageway and said lower end of said inner tubing is open for allowing passage of an elongated member downward through said inner tubing and upper annular seal from the ground surface to below said lower end of said inner tubing.

6. The tool of claim 5 wherein said annular housing has an interior chamber and an open bottom end for allowing passage of the elongated member downward through and to below said annular housing.

7. The tool of claim 1 wherein said lower end of said outer tubing is externally threaded and spaced above said lower end of said inner tubing, said annular housing having an internally threaded open top end and being coupled to said outer tubing by being threadably secured at said open top end about said lower end of said outer tubing.

8. The tool of claim 7 wherein said entry hole in said annular housing is located below said lower end of said outer tubing.

9. The tool of claim 8 wherein said annular housing has a plurality of said entry holes formed therein and located below said lower end of said outer tubing.

10. The tool of claim 9 wherein said entry holes are spaced from one another circumferentially about said annular housing.

11. The tool of claim 7 further comprising:

a lower annular seal provided between said inner tubing and said annular housing below said entry hole in said annular housing so as to block flow of fluid from said inner annulus downward below said lower end of said inner tubing.

12. In a casing of a well extending downward from ground surface through an underground fluid production zone and having an interior bore extending downward from said ground surface to below said production zone and an opening in said casing adjacent to said production zone allowing flow of fluid from the production zone into said bore of said casing, a dual annulus production tool, comprising:

(a) an upper annular seal provided in said bore of said casing of said well spaced below ground surface and above said opening in said casing of said well and in sealing relationship with said casing;

(b) an elongated outer tubing provided in said bore of said casing of said well extending from said ground surface downward through and in a sealing relationship with said upper annular seal to an lower end of said outer tubing located below said upper annular seal, said outer tubing having an imperforate tubular sidewall and a diameter sufficiently smaller than a diameter of said casing of said well to define an outer annulus therebetween for holding an annular volume of a static fluid therein extending from above said upper annular seal to said ground surface to impede corrosion of said casing of said well;

(c) an elongated inner tubing provided in said bore of said casing of said well within said outer tubing extending from said ground surface downward to a lower end of said inner tubing located below said upper annular seal, said inner tubing having an imperforate tubular sidewall and a diameter sufficiently smaller than said diameter of said outer tube to define an inner annulus therebetween being non-communicative with said outer annulus for routing flow of fluid from below said upward annular seal upward through said inner annulus to ground surface without and due to said imperforate sidewalls of said outer and inner tubings being prevented from entering said outer annulus; and (d) an annular housing provided in said bore of said casing of said well below said upper annular seal and adjacent to said production zone, said annular housing being coupled to at least one of said respective lower ends of said outer and inner tubings, said annular housing having at least one fluid entry hole disposed above said opening in said casing for enabling flow of fluid from said casing into and upward through said inner annulus to said ground surface and thereby avoiding the flow of fluid entering said outer annulus and contacting said casing.

13. The tool of claim 12 further comprising:

a lower annular seal provided in said annular housing below said entry hole in said annular housing so as to block flow of fluid from said inner annulus downward below said annular housing.

14. The tool of claim 12 wherein said annular housing has a plurality of said entry holes formed therein.

15. The tool of claim 14 wherein said entry holes are spaced from one another circumferentially about said annular housing.

16. The tool of claim 12 wherein said inner tubing has an interior passageway and said lower end of said inner tubing is open for allowing passage of an elongated member downward through said inner tubing and upper annular seal from said ground surface to below said lower end of said inner tubing.

17. The tool of claim 16 wherein said annular housing has an interior chamber and an open bottom end for allowing passage of the elongated member downward through and to below said annular housing.

18. The tool of claim 12 wherein said lower end of said outer tubing is externally threaded and spaced above said lower end of said inner tubing, said annular housing having an internally threaded open top end and being coupled to said outer tubing by being threadably secured at said open top end about said lower end of said outer tubing.

19. The tool of claim 18 wherein said entry hole in said annular housing is located below said lower end of said outer tubing.

20. The tool of claim 19 wherein said annular housing has a plurality of said entry holes formed therein and located below said lower end of said outer tubing.

21. The tool of claim 20 wherein said entry holes are spaced from one another circumferentially about said annular housing.

22. The tool of claim 18 further comprising:

a lower annular seal provided between said inner tubing and said annular housing below said entry hole in said annular housing so as to block flow of fluid from said inner annulus downward below said lower end of said inner tubing.

* * * * *